US007794237B1

(12) United States Patent
Terhune, IV

(10) Patent No.: US 7,794,237 B1
(45) Date of Patent: Sep. 14, 2010

(54) ELECTRICAL CONNECTOR HAVING IMPROVED RETAINING ARRANGEMENT BETWEEN THE HOUSING AND THE CONTACTS

(75) Inventor: Albert Harvey Terhune, IV, Chandler, AZ (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/583,468

(22) Filed: Aug. 21, 2009

(51) Int. Cl.
*H01R 12/00* (2006.01)

(52) U.S. Cl. ..... 439/71; 439/66

(58) Field of Classification Search ..... 439/66, 439/71, 81, 83

See application file for complete search history.

(56) References Cited

U.S. PATENT DOCUMENTS 4,636,026 A * 1/1987 Cooney et al. ..... 439/482
4,718,166 A * 1/1988 DeFilippis et al. ..... 29/845
4,838,801 A * 6/1989 Bertoglio et al. ..... 439/83
5,215,472 A * 6/1993 DelPrete et al. ..... 439/71
6,241,560 B1 * 6/2001 Furusawa et al. ..... 439/700
7,097,485 B1 * 8/2006 Wang et al. ..... 439/289
7,261,568 B2 * 8/2007 Ju et al. ..... 439/66

* cited by examiner

*Primary Examiner*—Thanh-Tam T Le
(74) *Attorney, Agent, or Firm*—Andrew C. Cheng; Wei Te Chung; Ming Chieh Chang

(57) ABSTRACT

An electrical connector comprises an insulative housing defining a plurality of passageways, the passageways each defining an upper section, a lower section of a diameter larger than that of the upper section, and a plurality of contact sets respectively disposed in the passageways. Each of the contacts sets includes an upper contact loosely captured within the upper section and a lower contact retained in the lower section. The upper contact defines a lower end extending in the lower section and is able to abut against an interface between the two sections, so as to retrain upward movement of the upper contact. The upper contact is movable relating to the lower contact under condition that one of said upper contact and the lower contact is deformed to provide a restored force to ensure electrical connection between the two contacts when the upper contact is moved toward said lower contact.

20 Claims, 10 Drawing Sheets

ELECTRICAL CONNECTOR HAVING IMPROVED RETAINING ARRANGEMENT BETWEEN THE HOUSING AND THE CONTACTS

BACKGROUND OF THE INVENTION

1. Field of the Invention

The present invention relates to an electrical connector for electrically connecting an electronic package such as a microprocessor with a circuit substrate such as a printed circuit board (PCB), and more particularly to an electrical connector having improved retaining arrangement between the housing and the contacts.

2. Description of Prior Art

Electronic component sockets are known for retaining leadless components. Generally, such sockets include an array of resilient contacts in a predetermined pattern corresponding to the terminal pattern of the component or device to be mounted on the socket, and means for retaining the leadless component in position with the component terminals mated with the socket contacts.

U.S. Pat. No. 4,838,801 issued to Bertoglio on Jun. 13, 1989 discloses an electronic component sockets, which provides several solutions for retaining the leadless component in position with the component terminals mated with the socket contacts. Bertoglio disclosed an electronic component sockets comprising a socket body of electrically insulative material and planar, substantially parallel, top and bottom surfaces, and a plurality of openings between the surfaces in an array to provide an intended contact pattern. A two-piece spring contact assembly is retained in respective openings, with one element retained within the opening and having an outwardly extending lead for soldering or other connection to a circuit board on which the socket is mounted, and the other element extending above the upper socket surface in a position to engage the confronting terminals of a leadless component or device, such as a leadless chip carrier.

As shown in FIG. 2, the element 24*a* is loosely captured by element 36*a*, and this assembly is loosely retained within the opening 16*a* of socket body 10*a* by retention ring 50 provided in opening 16*a*. The ring is designed with a diameter large enough to prevent removal of the assembled spring contact from either the top or the bottom of the opening. The element 24*a* has a solder lead 52 extending outward from the bottom surface 14*a* of the socket body. However, the ring is only capable of preventing the element 36*a* from the bottom of the opening or the element 24*a* from the top of the opening. Thus, before the socket is mounted onto a circuit board, element 24*a* and the element 36*a* will face a risk of falling from the opening from the bottom or the top.

In view of the above, an improved electrical connector that overcomes the above-mentioned disadvantages is desired.

SUMMARY OF THE INVENTION

Accordingly, an object of the present invention is to provide an electrical connector for electrically connecting an electronic package such as a CPU with a circuit substrate such as a PCB, which can provide an improved retaining arrangement between the housing and the contacts.

To achieve the above-mentioned object, an electrical connector in accordance with a preferred embodiment of the present invention for electrically connecting an electronic package with a PCB is provided. The electrical connector comprises an insulative housing defining a plurality of passageways, each of the passageways defining an upper section and a lower section with a diameter larger than that of the upper section, a plurality of contact respectively disposed in said passageways. Each of the contacts includes an upper contact, which is located in the upper section and defines a lower end extending into the lower section and below an interface between said two sections, engageably supported by a lower contact, which is retained in the lower section of the passageway, an upper end extending above an upper surface of the housing for engaging with an electrical package. The upper contact is configured to be up and down movable between the upper section and the lower section, relating to the lower contact in a restraint manner under condition that at least one of said upper contact and said lower contact is deformed to provide a restored force to ensure electrical connection between said upper contact and said lower contact when the upper contact is moved toward said lower contact, and under condition that upward movement of the upper contact is limited by the lower end of the upper contact abutting against the interface. In the present invention, improved retaining arrangement between the housing and the contact sets is provided.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Figure 1:
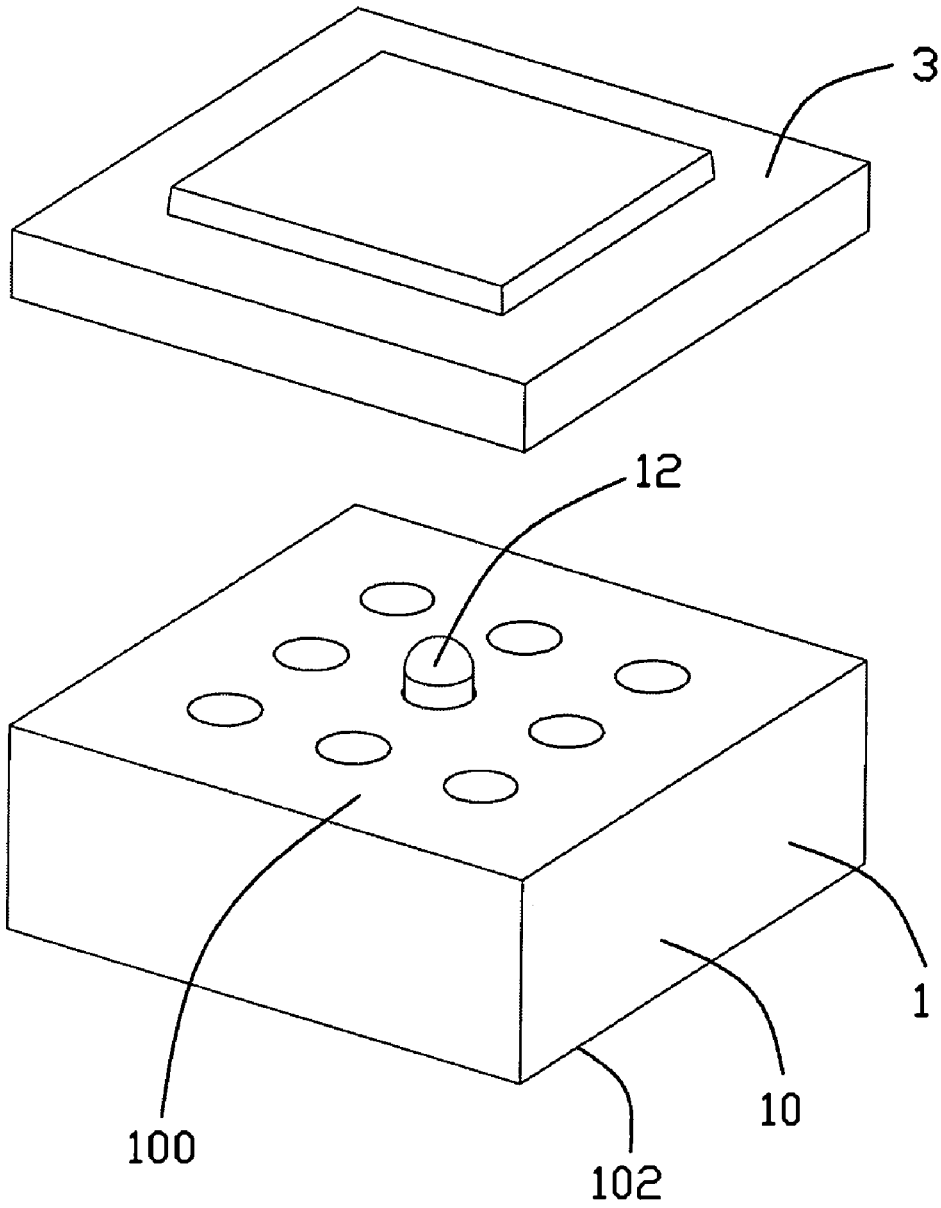
FIG. 1 is an assembly view of an electrical connector in accordance with a first embodiment of the present invention.
Figure 2:
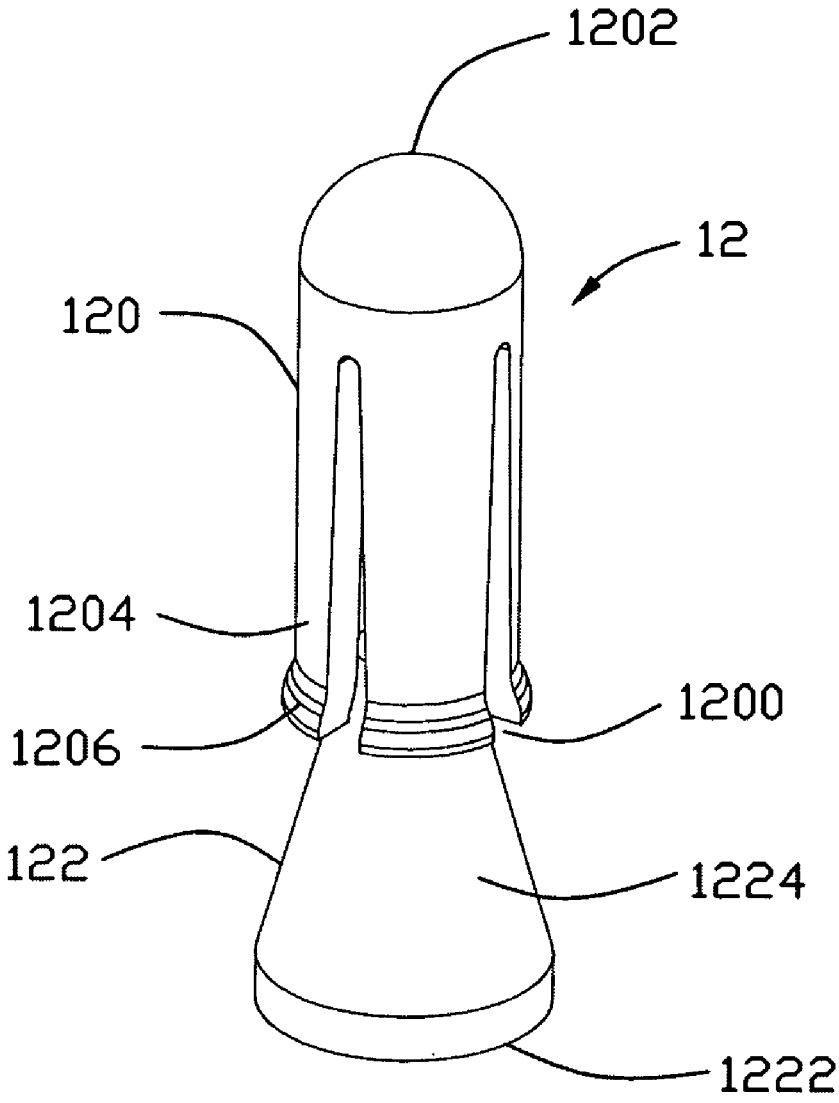
FIG. 2 is an isometric, assembly view of the contact set in accordance with a first embodiment of the present invention.
Figure 3:
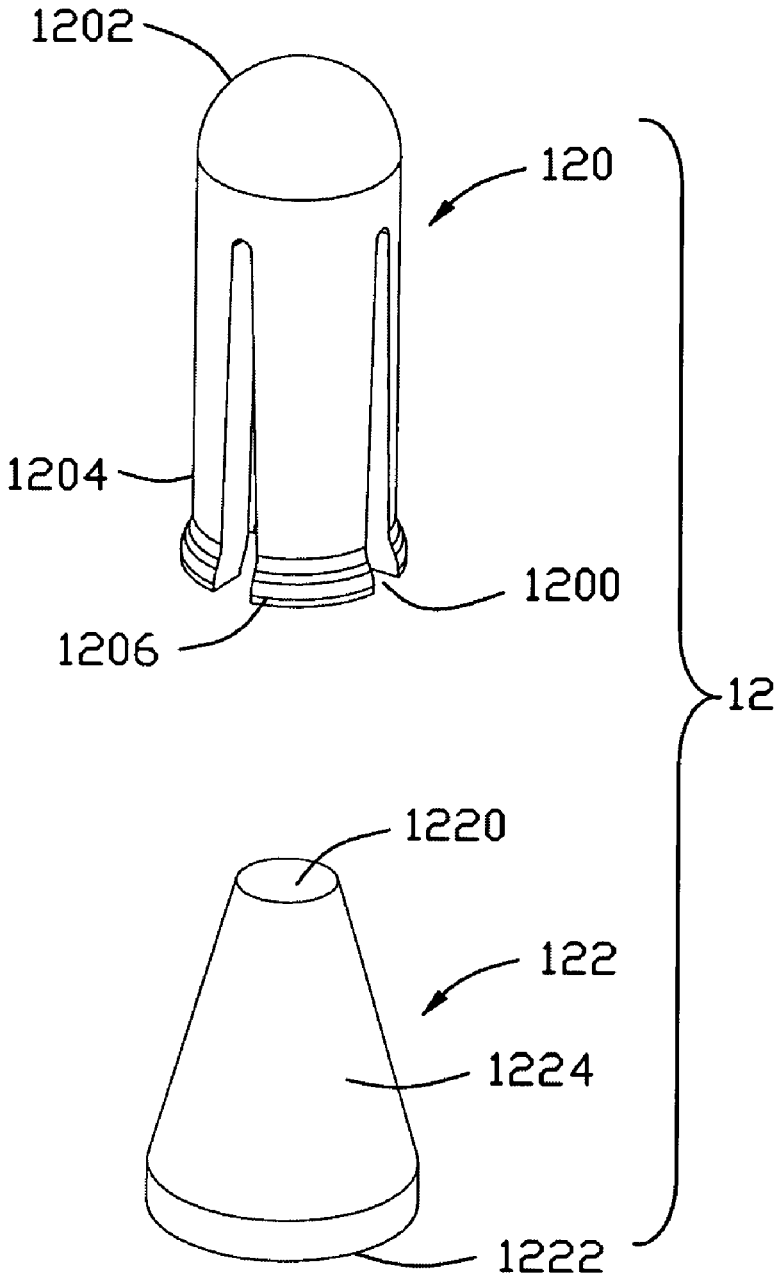
FIG. 3 is an isometric, exploded view of the contact set in accordance with a first embodiment of the present invention.

Reference will now be made to the drawings to describe the present invention in detail.

Referring to FIGS. 1-5, an electrical connector 1 in accordance with a first preferred embodiment of the present invention is used for electrically connecting an electrical package 3 with a PCB 4. The connector 1 comprises an insulative housing 10 and a plurality of contact sets 12.

The insulative housing 10 defines an upper surface 100, a bottom surface 102 opposite to the upper surface 100, and a plurality of passageways 104 extending between the upper surface 100 and a bottom surface 102. Each of the passageways 104 defining an upper section 1040 and a lower section 1042 of a diameter larger than that of the upper section 1040. The upper section 1040 is terminated at the upper surface 100 and the lower section 1042 is terminated at the bottom surface 102. An interface 1044 is formed between the two sections.

The contact sets 12 are respectively disposed in the passageways 104 and comprises an upper contact 120, which is receiving in the upper section 1040, and a lower contact 122, which is secured in the lower section 1042 by interference fit. The upper contact 120 is a sleeve configured with several spits 1200 extending therethrough. The upper end of the sleeve is sealed, and the lower end of the sleeve is unsealed. Thus, the upper contact 120 defines a cavity for receiving and engaging with an upper contact tip 1220 of the lower contact 122. The upper end 1202 of the upper contact 120 extends above the upper surface 100 of the housing 10 for engaging with the electrical package 3. The splits 1200 extend substantially along an axis direction of the sleeve from a top position of the sleeve, so as to form several spring fingers 1204 spaced to one another. Each of the spring fingers 1204 extends along the axis direction of the sleeve, which is also the extending direction of the passageway 104. In addition, each of the spring fingers 1204 defines a free end extending into the lower section 1042 of the housing 10 and below the interface 1044 between the two sections. In another word, all the free ends of the spring finger 1204 that extend in the lower section 1042 form a flange 1206 having a diameter larger than the diameter of the upper section 1040, so as to limit upward movement of the upper contact 120. Each of the free ends of the spring fingers 1204 extends along a direction angled with the axis direction of the sleeve, which is away from a centerline of the passageway 104.

Referring to FIGS. 2-5, the lower contact 122 defines an upper contact tip 1220 slidable in the cavity of the sleeve and a lower contact tip 1222 extending below the bottom surface 102 of the housing 10. The upper contact tip 1220 has a conical surface 1224 tapering in a bottom-to-up direction.

Figure 4:
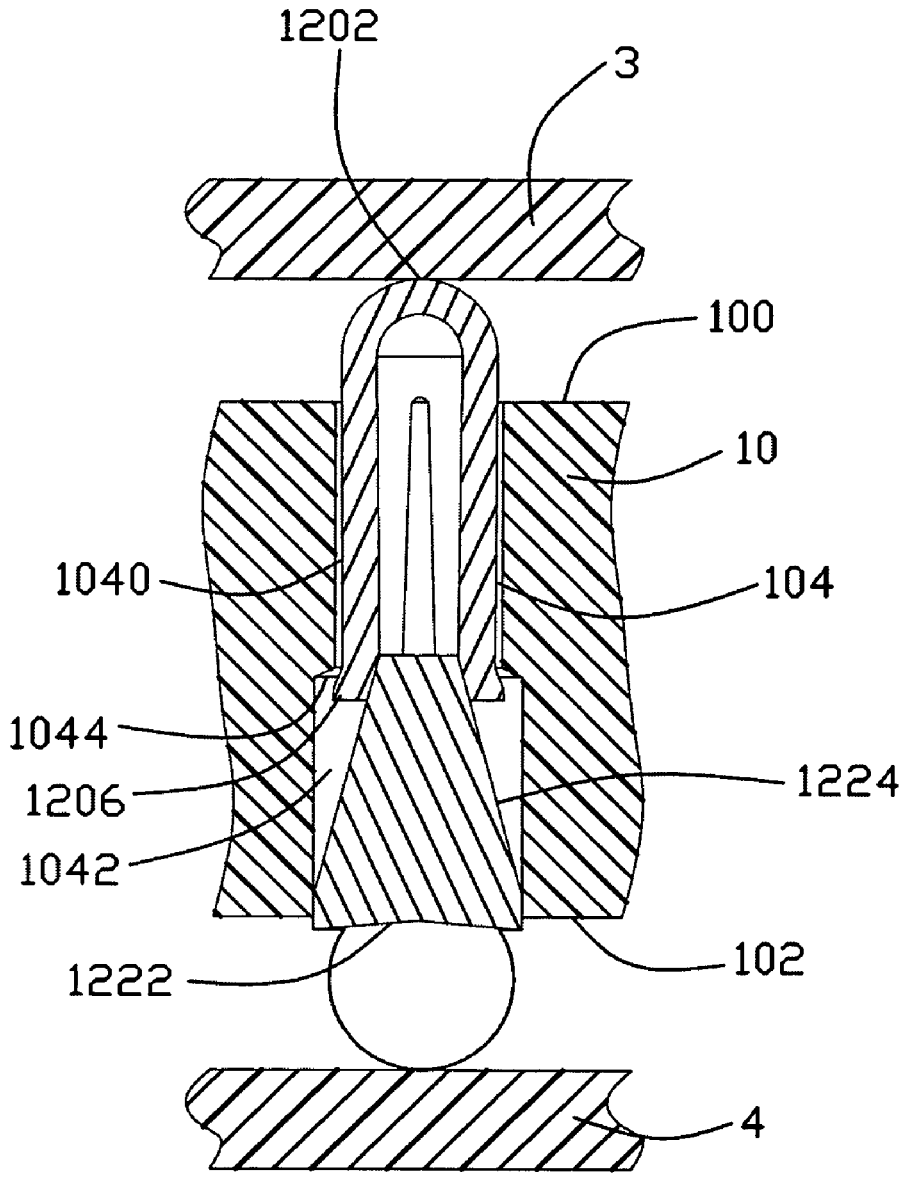
FIG. 4 is a section view of electrical connector in accordance with a first embodiment, showing the upper contact at a first position.
Figure 5:
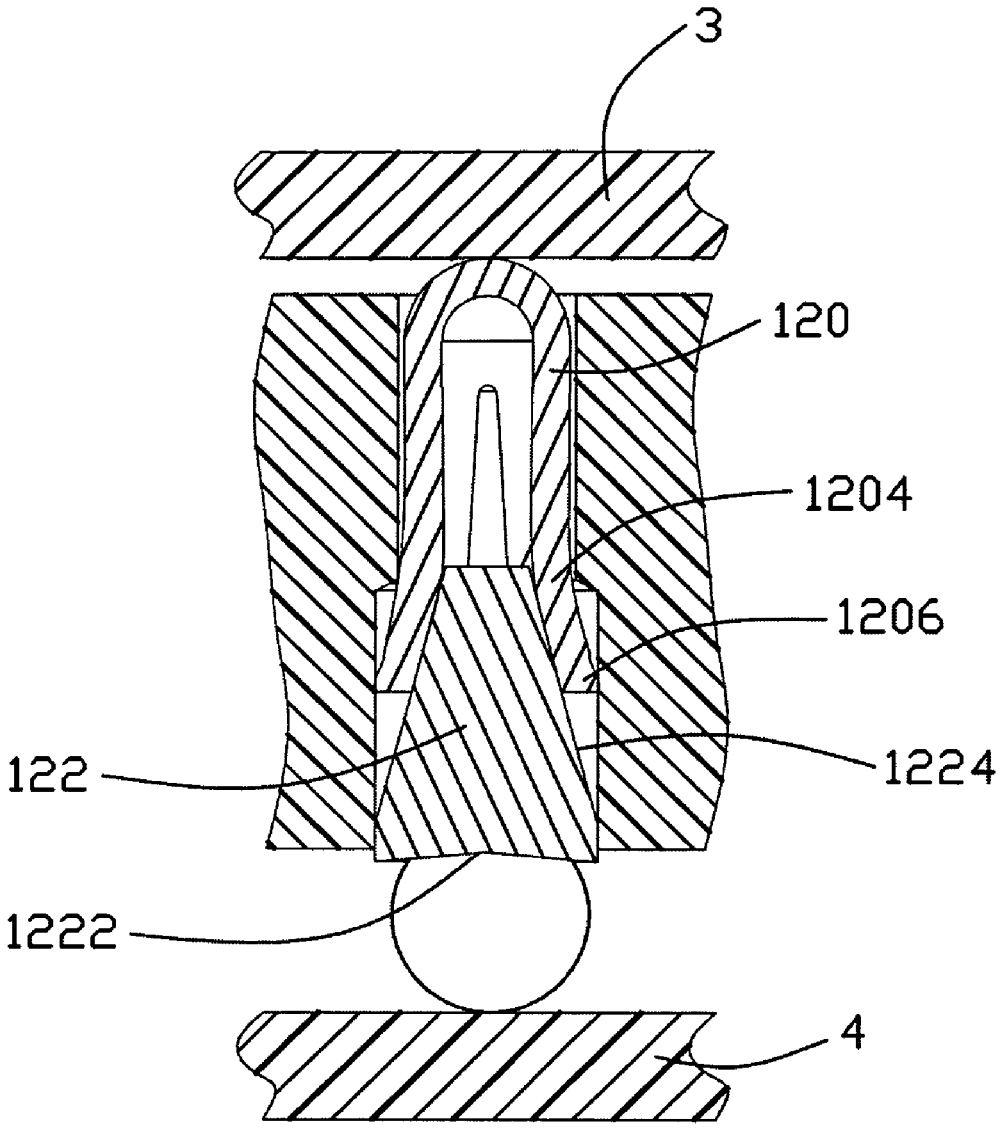
FIG. 5 is similar with FIG. 4, but showing the upper contact at a second position.
Figure 6:
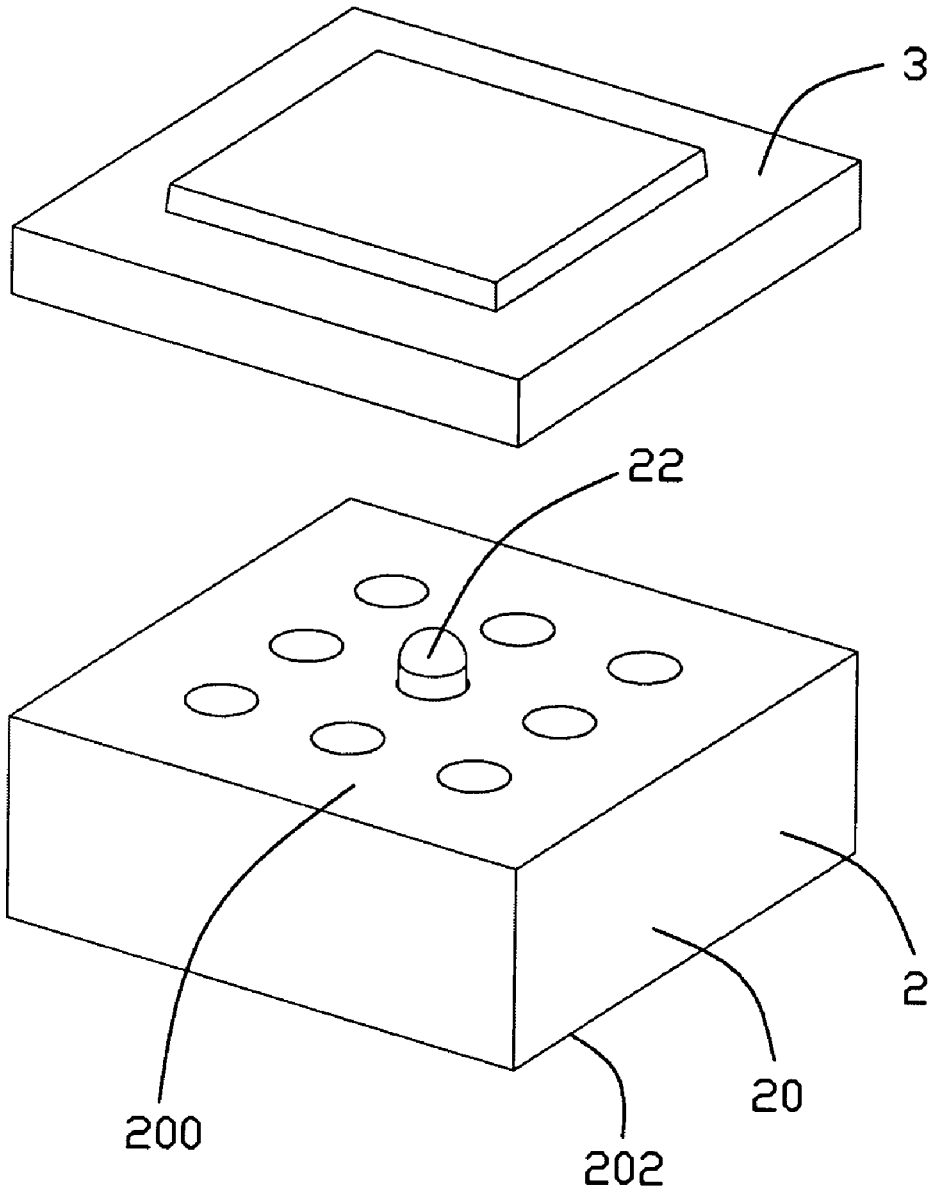
FIG. 6 is an assembly view of an electrical connector in accordance with a second embodiment of the present invention.
Figure 7:
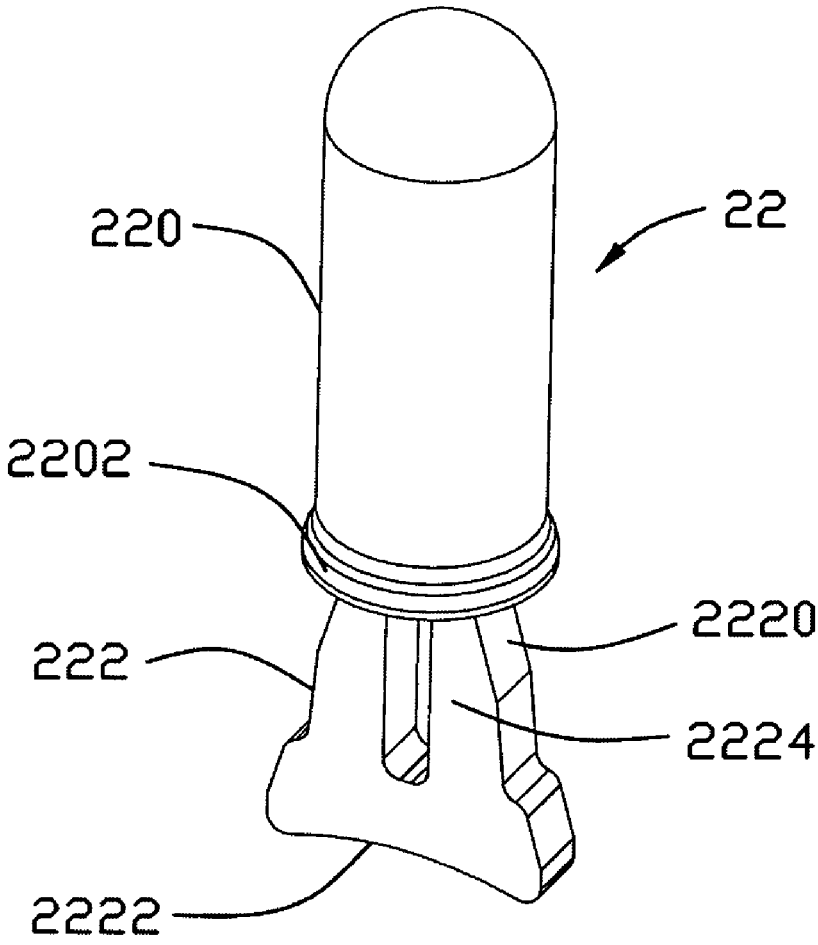
FIG. 7 is an isometric, assembly view of the contact set in accordance with a second embodiment of the present invention.
Figure 8:
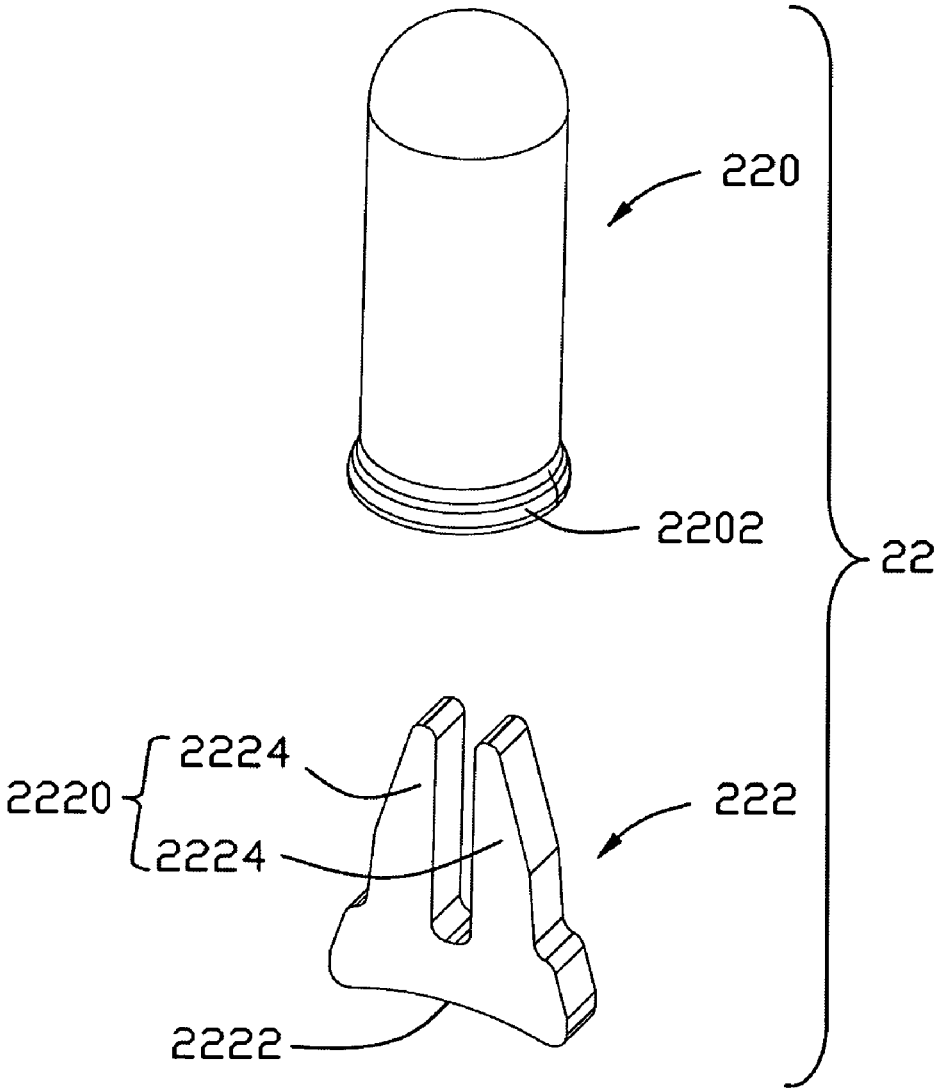
FIG. 8 is an isometric, exploded view of the contact set in accordance with a second embodiment of the present invention.
Figure 9:
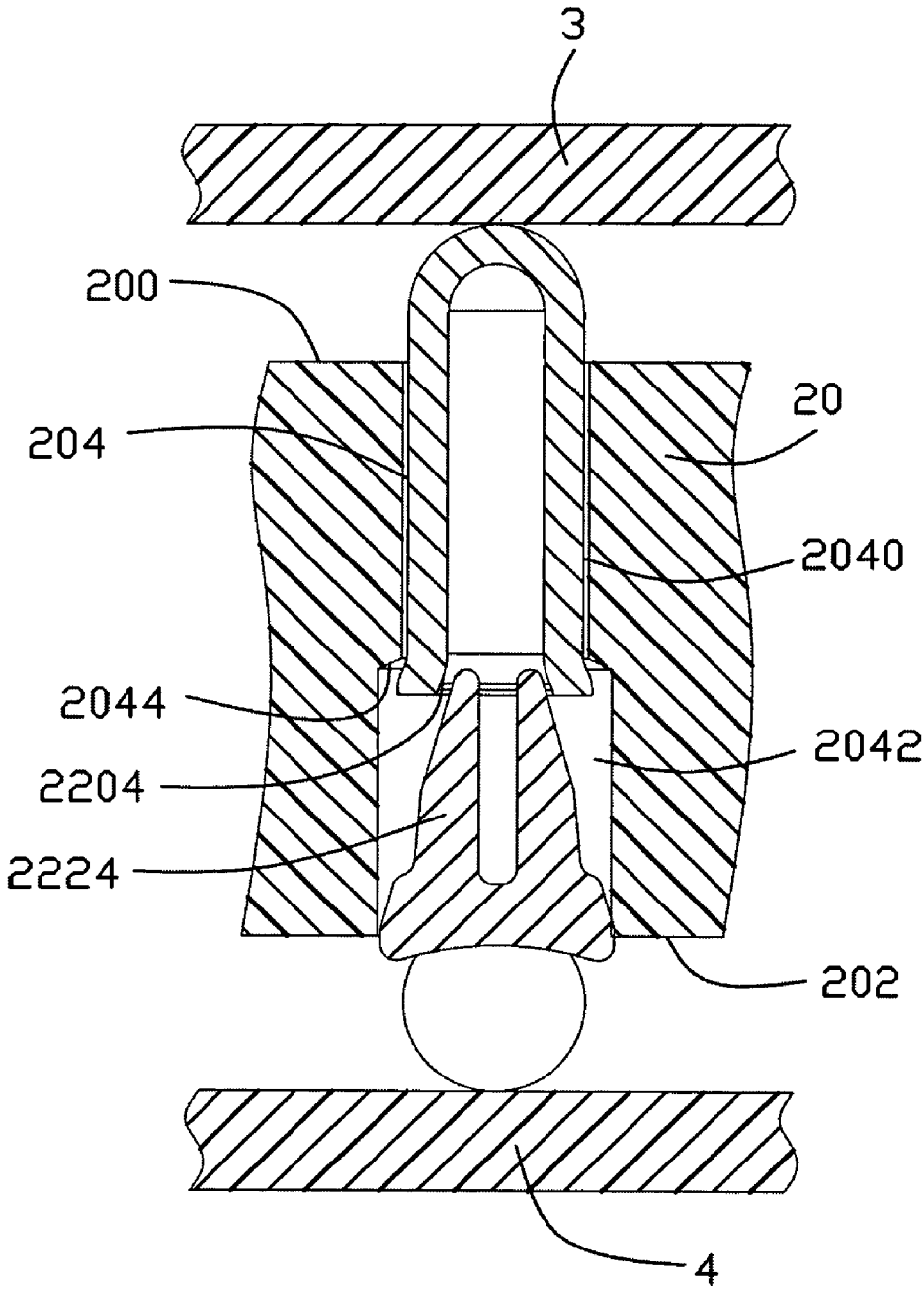
FIG. 9 is a section view of the electrical connector in accordance with a second embodiment, showing the upper contact at a first position.
Figure 10:
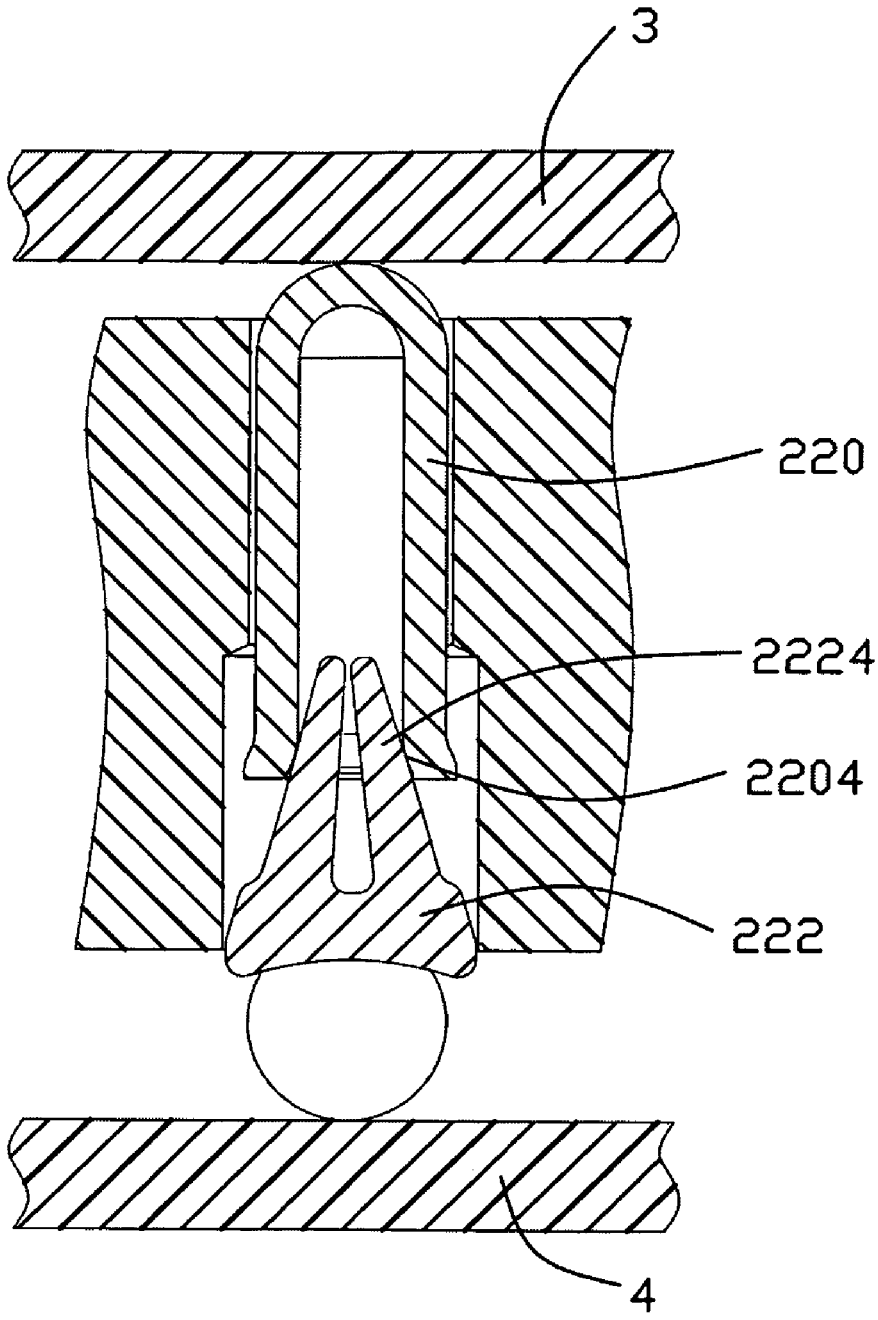
FIG. 10 is similar with FIG. 9, but showing the upper contact at a second position.

Referring to FIGS. 4-5, to mount the electrical connector 1 on a PCB 4, the lower contact 12 is retained in the lower section 1042 of the passageway 104 by interference fit, and the upper contact 120 is loosely captured within the upper section 1040 of the passageway 104. In an up-to-bottom direction, the upper contact 120 is engageably supported by the lower contact 122. When a downward force is applied to the electrical package 3, the upper contact 120 will be pressed and moved toward the lower contact 122. The downward fore causes the spring fingers 1204 to ride along the conical surface 1224 and to produce an upwardly biased spring force for maintaining proper contact engagement between the upper contact 120 and the lower contact 122. Thus, the spring fingers 1204 will be deformed and moved in a direction transverse to the axis direction of passageway 104. The lower contacting pin 1222 of the lower contact 122 extends below the bottom surface 102 of the housing 10 and can be soldered to the PCB 4. Accordingly, the electrical connector 1 establishes electrical connecting between the electrical package 3 and the PCB 4.

Referring to FIG. 4, before the downward force is applied to the electrical package 3, the upper contact 120 is at an original position, which ensures the upper end 1202 of the upper contact 120 extending above the upper surface 100 of the housing 10. The upper contact 12 is limited in the passageway 104 in bottom-to-up direction by the free ends of the spring fingers abutting against the interface 1044.

An alternative embodiment is shown in FIGS. 6-10. The electrical connector 2 comprises an insulative housing 20 and a plurality of contact sets 22. The upper contact 220 is loosely captured within the upper section 2040 of the passageway 204 with the upper end 2200 extending above the upper surface 200 of the housing 20. The lower contact 22 is retained in the lower section 2042 of the passageway 204 by interference fit with the lower contacting pin 2222 extending below the bottom surface 202 of the housing 20.

A variation of this embodiment is shown in FIGS. 7-10 wherein the upper contact 220 is of a sleeve configuration, which has a lower end 2202 extending into the lower section 2042 and below the interface 2042, so as to prevent the upper contact 220 falling out from the upper surface 220 of the housing 20. The lower contact 222 defines an upper contact tip 2220 slidable in the cavity of the upper contact 220 and a lower contacting pin 2222 for soldering to the PCB 4. The upper contact tip 2220 of the lower contact 222 comprises two spaced spring fingers 2224 able to be inserted into the sleeve. Each of the spring fingers 2224 inclines toward a centerline of the passageway in the bottom-to upper direction. In addition, the upper contact 220 defines an inner surface 2204 in compliance with the inclined spring fingers 2224 and formed at the lower end 2202 thereof, which also inclines toward a centerline of the passageway in the bottom-to upper direction.

When a downward force is applied to the electrical package 3, the upper contact 220 will be pressed and moved toward the lower contact 222. The downward fore causes the spring fingers 2224 of the lower contact 222 to ride along the inner surface 2204 and to produce an inwardly biased spring force for maintaining proper contact engagement between the upper contact 220 and the lower contact 222. Thus, the spring fingers 2224 will be deformed and moved in a direction transverse to the axis direction of passageway 204. The lower contacting pin 2222 of the lower contact 222 extends below the bottom surface 202 of the housing 20 and can be soldered to the PCB 4. Therefore, the electrical connector 1 establishes electrical connecting between the electrical package 3 and the PCB 4. Furthermore, upward movement of the upper contact 220 will be restrained by the interface 2044. In the present invention, improved retaining arrangement between the housing and the contacts is provided.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

a housing defining a plurality of passageways, each of said passageways defining an upper section and a lower section of a diameter larger than that of the upper section;

a plurality of contact sets respectively disposed in said passageways, each of said contact sets including an upper contact, which is located in the upper section and defines a lower end extending into the lower section and below an interface between said two sections, engageably supported by a lower contact, which is retained in the lower section of the passageway, an upper end of the upper contact extending above an upper surface of the housing for engaging with an electrical package; wherein the upper contact is configured to be capable of moving up and down between the upper section and the lower section, relating to the lower contact in a restraint manner under condition that at least one of said upper contact and said lower contact is compliant to provide a restored force to ensure electrical connection between said upper contact and said lower contact when the upper contact is moved toward said lower contact;

wherein a free end of the lower end of the upper contact forms a flange abutting against the interface to limit upward movement of the upper contact; and wherein the free end extends along a direction angled with a movement direction of the upper contact, which is outwardly away from a centerline of the passageways.

2. The electrical connector as claimed in claim 1, wherein the upper contact is a sleeve configured with several spits extending therethrough substantially along an axis direction of the sleeve from a top position of the sleeve, so as to form several spring fingers spaced to one another.

3. The electrical connector as claimed in claim 2, wherein upper end of the sleeve extends above the upper surface of the housing.

4. The electrical connector as claimed in claim 3, wherein each of said spring fingers defines a free end extending into the lower section of the housing and below the interface between the two sections.

5. The electrical connector as claimed in claim 4, wherein the lower contact defines an upper contact tip, which has a conical surface tapering in a bottom-to-up direction for slidable in the sleeve and engaging with the spring fingers.

6. The electrical connector as claimed in claim 5, wherein the lower contact defines a lower contacting tip extending below the bottom surface of the housing.

7. An electrical connector for electrically connecting two exterior electronic components, comprising:

an insulative housing defining a plurality of passageways between an upper surface and a bottom surface;

a plurality of contact sets respectively disposed in a passageway, each of said contact sets including an upper contact, each of said contact sets including:

a first element disposed within the passageway adjacent the upper surface of the housing and having an upper end extending above the upper surface;

a second element disposed with the passageway adjacent the bottom surface of the housing and having an extending lead for attachment to a contact element of a mounting member; wherein one of the elements is immovably retained in the passageway; and the other one of the elements is moveably loosely captured within the passageway; wherein said passageway defines a stopper structure in a middle portion thereof, so as to prevent the loose element from falling out of corresponding adjacent surface; wherein the stopper structure is an interface extending along a direction transverse to an axis direction of the passageway; and wherein a free end of a lower end of the upper contact forms a flange outwardly abutting against the interface to limit upward movement of the upper contact and extends along a direction angled with a movement direction of the upper contact.

8. The electrical connector as claimed in claim 7, wherein one of the elements has a compliance surface, and the other one of the element has spring means cooperative with the compliance surface, the spring means being movable in the direction transverse to the axis of the passageway.

9. The electrical connector as claimed in claim 8, the passageway of the housing has a larger diameter portion terminating at the bottom surface and a small diameter portion terminating at the upper surface.

10. The electrical connector as claimed in claim 9, wherein the first element is a sleeve configured with several spits extending therethrough substantially along an axis direction of the sleeve from a top position of the sleeve, so as to form several spring fingers spaced to one another.

11. The electrical connector as claimed in claim 10, wherein each of said spring fingers defines a free end extending into the larger diameter portion of the housing and below an interface between the two sections.

12. The electrical connector as claimed in claim 11, wherein the second element defines an upper contact tip, which has a conical surface tapering in a bottom-to-up direction for slidable in the sleeve and engaging with the spring fingers.

13. The electrical connector as claimed in claim 9, wherein the first element is a sleeve configured with a free end extending into the larger diameter portion of the housing and below the interface between the two sections.

14. The electrical connector as claimed in claim 13, wherein the second element defines an upper contact pin slidable in the sleeve, the upper contact pin being of two spaced spring fingers.

15. The electrical connector as claimed in claim 14, wherein the two spaced spring fingers incline toward a centerline of the passageway.

16. The electrical connector as claimed in claim 7, wherein the first element, which is moveably loosely captured in the passageway, defines a sleeve structure with a closed end exposed outside of the passageway and an open end compliantly receiving a wedge like structure formed on the second element which is secured in the passageway.

17. The electrical connector as claimed in claim 16, wherein one of the sleeve structure and the wedge structure is equipped with axial slots to provide radial deflection and corresponding spring forces thereof when the sleeve structure is moved toward and forcibly engaged with the wedge structure.

18. An electrical socket connector, comprising:

an insulative housing having a mating interface and a mounting interface, a plurality of passageways defined between the mating interface and the mounting interface within a ridge formed substantially in a middle thereof;

a first contact inserted into a passageway and having a contacting engaging portion extending beyond the mating interface, and an expandable portion located under the ridge portion preventing the first contact from coming out of the passageway from the mating interface; and a second contact securely attached to the passageway from the mounting surface and including a driving portion located adjacent to the expandable portion and a retaining portion engaged with a side wall of the passageway around the mounting interface; wherein each of said passageways defines an upper vertical section and a lower vertical section linked with each other via the corresponding ridge therebetween, said lower vertical section is diametrically larger than the upper vertical section, and the contact engaging portion of the corresponding first contact extends in a vertical manner so as to compliantly intimately move along the upper vertical section vertically; wherein the ridge is an interface extending along a direction transverse to an axis direction of the passageway; and wherein a free end of the expandable portion of first contact forms a flange outwardly abutting against the interface to limit upward movement of the first contact and extends along a direction angled with a movement direction of the first contact.

19. The socket connector as recited in claim 18, wherein the second contact is provided with a solder mass at a lower end thereof.

20. The socket connector as recited in claim 18, wherein a dimension of the upper vertical section in a vertical direction and that the lower vertical section in are roughly equal to each other.

* * * * *